US011765537B2

(12) United States Patent
Wang et al.

(10) Patent No.: US 11,765,537 B2
(45) Date of Patent: Sep. 19, 2023

(54) METHOD AND HOST FOR ADJUSTING AUDIO OF SPEAKERS, AND COMPUTER READABLE MEDIUM

(71) Applicant: HTC Corporation, Taoyuan (TW)

(72) Inventors: Yen-Chieh Wang, Taoyuan (TW); Li-Hsun Chang, Taoyuan (TW); Sung Jen Wang, Taoyuan (TW); Chien-Hung Lin, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 17/539,209

(22) Filed: Dec. 1, 2021

(65) Prior Publication Data

US 2023/0171556 A1 Jun. 1, 2023

(51) Int. Cl.

| | |
|---|---|
| ***H04S 7/00*** | (2006.01) |
| ***H04R 5/04*** | (2006.01) |
| ***H04R 3/00*** | (2006.01) |

(52) U.S. Cl.

CPC ..... *H04S 7/301* (2013.01); *H04R 3/005* (2013.01); *H04R 5/04* (2013.01); *H04S 2400/11* (2013.01); *H04S 2420/01* (2013.01)

(58) Field of Classification Search

CPC .. H04S 7/301; H04S 2400/11; H04S 2420/00; H04S 2420/01; H04R 3/005; H04R 5/04

USPC ..... 381/1, 2, 56, 58, 303

See application file for complete search history.

(56) References Cited

U.S. PATENT DOCUMENTS

| | | | | |
|---|---|---|---|---|
| 2008/0037804 | A1* | 2/2008 | Shmunk | H04S 7/301 381/59 |
| 2012/0057732 | A1 | 3/2012 | Choi et al. | |
| 2012/0237037 | A1* | 9/2012 | Ninan | H04S 7/304 381/17 |
| 2014/0064507 | A1 | 3/2014 | Su et al. | |
| 2018/0109895 | A1* | 4/2018 | Audfray | H04S 7/302 |

OTHER PUBLICATIONS

"Office Action of Taiwan Counterpart Application", dated Feb. 22, 2023, p. 1-p. 10.

* cited by examiner

*Primary Examiner* — William A Jerez Lora
(74) *Attorney, Agent, or Firm* — JCIPRNET

(57) ABSTRACT

The disclosure provides a method and a host for adjusting audio of speakers, and a computer readable medium. The method includes: controlling a far-field speaker to play a first audio signal; controlling an audio receiver to receive the first audio signal from the far-field speaker and accordingly positioning a speaker location of the far-field speaker; establishing a first hearing transfer function related to the far-filed speaker based on the speaker location of the far-filed speaker; controlling the far-field speaker to play a second audio signal based on a second hearing transfer function; controlling the audio receiver to receive the second audio signal and accordingly estimating a first reference hearing volume; obtaining a second reference hearing volume corresponding to a first near-field speaker; and adjusting a first volume of the far-field speaker based on the first reference hearing volume and the second reference hearing volume.

20 Claims, 8 Drawing Sheets

METHOD AND HOST FOR ADJUSTING AUDIO OF SPEAKERS, AND COMPUTER READABLE MEDIUM

BACKGROUND OF THE INVENTION

1. Field of the Invention

The disclosure generally relates to a volume management mechanism, in particular, to a method and a host for adjusting audio of speakers, and a computer readable medium.

2. Description of Related Art

At present, the way that people listen to music is mainly through earphones and mini speakers, which provide sound perception inside the head. With head related transfer function (HRTF) and 3D surround effects, virtual world sound effects can be achieved. However, due to physical limitations and small driving elements of mini speakers, it is not easy to provide audio bandwidth, volume and directionality approaching to real sounds. In this case, game scenes that need spatial sound effects cannot be truly presented.

SUMMARY OF THE INVENTION

Accordingly, the disclosure is directed to a method and a host for adjusting audio of speakers, and a computer readable medium.

The embodiments of the disclosure provide a method for adjusting audio of speakers, adapted to a host. The method includes: controlling a far-field speaker to play a first audio signal; controlling an audio receiver to receive the first audio signal from the far-field speaker and accordingly positioning a speaker location of the far-field speaker; establishing a first hearing transfer function related to the far-filed speaker based on the speaker location of the far-filed speaker; controlling the far-field speaker to play a second audio signal based on a second hearing transfer function, wherein the second hearing transfer function is inversed to the first hearing transfer function; controlling the audio receiver to receive the second audio signal and accordingly estimating a first reference hearing volume; obtaining a second reference hearing volume corresponding to a first near-field speaker; and adjusting a first volume of the far-field speaker based on the first reference hearing volume and the second reference hearing volume.

The embodiments of the disclosure provide a host for adjusting audio of speakers, including a storage circuit and a processor. The storage circuit stores a program code. The processor is coupled to the storage circuit and accesses the program code to perform: controlling a far-field speaker to play a first audio signal; controlling an audio receiver to receive the first audio signal from the far-field speaker and accordingly positioning a speaker location of the far-field speaker; establishing a first hearing transfer function related to the far-filed speaker based on the speaker location of the far-filed speaker; controlling the far-field speaker to play a second audio signal based on a second hearing transfer function, wherein the second hearing transfer function is inversed to the first hearing transfer function; controlling the audio receiver to receive the second audio signal and accordingly estimating a first reference hearing volume; obtaining a second reference hearing volume corresponding to a first near-field speaker; and adjusting a first volume of the far-field speaker based on the first reference hearing volume and the second reference hearing volume.

The embodiments of the disclosure provide a computer readable medium, the computer readable medium recording an executable computer program, the executable computer program being loaded by a host to perform steps of: controlling a far-field speaker to play a first audio signal; controlling an audio receiver to receive the first audio signal from the far-field speaker and accordingly positioning a speaker location of the far-field speaker; establishing a first hearing transfer function related to the far-filed speaker based on the speaker location of the far-filed speaker; controlling the far-field speaker to play a second audio signal based on a second hearing transfer function, wherein the second hearing transfer function is inversed to the first hearing transfer function; controlling the audio receiver to receive the second audio signal and accordingly estimating a first reference hearing volume; obtaining a second reference hearing volume corresponding to a first near-field speaker; and adjusting a first volume of the far-field speaker based on the first reference hearing volume and the second reference hearing volume.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
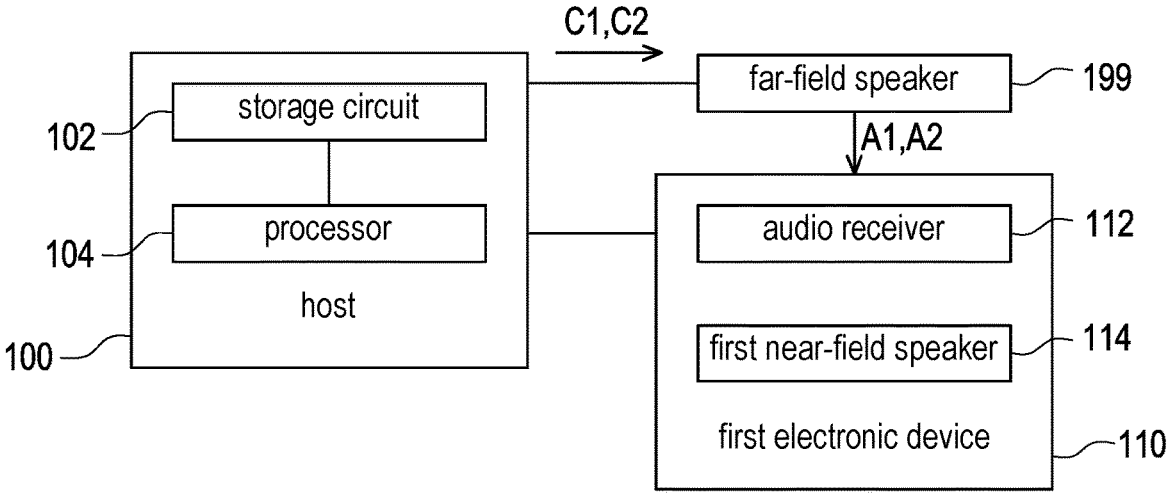
FIG. 1A shows a functional block diagram illustrating a host, a first electronic device and a far-field speaker according to an embodiment of the disclosure.

Reference will now be made in detail to the present preferred embodiments of the invention, examples of which are illustrated in the accompanying drawings. Wherever possible, the same reference numbers are used in the drawings and the description to refer to the same or like parts.

See FIG. 1A, which shows a functional block diagram illustrating a host, a first electronic device and a far-field speaker according to an embodiment of the disclosure. In FIG. 1A, the host 100 includes a storage circuit 102 and a processor 104. The storage circuit 102 is one or a combination of a stationary or mobile random access memory (RAM), read-only memory (ROM), flash memory, hard disk, or any other similar device, and which records a program code and/or a plurality of modules that can be executed by the processor 104.

The processor 104 may be coupled with the storage circuit 102, and the processor 104 may be, for example, a graphic processing unit (GPU), a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Array (FPGAs) circuits, any other type of integrated circuit (IC), a state machine, and the like.

In the embodiment, the first electronic device 110 can be a head-mounted display (HMD) or other similar device that can provide sounds (e.g., the sounds related to the contents shown by the HMD) to the user/wearer thereof. In one embodiment, the host 100 may be a computer connected with the first electronic device 110 and provide the contents to the first electronic device 110 to show, but the disclosure is not limited thereto.

In FIG. 1A, the first electronic device 110 includes an audio receiver 112 and a first near-field speaker 114. In various embodiments, the audio receiver 112 can include microphones and/or microphone arrays or any other similar devices for receiving audio signals. In some embodiments, the microphones and/or microphone arrays can be disposed on the positions near the ears of the user for receiving the audio signals, but the disclosure is not limited thereto.

In FIG. 1A, the far-field speaker 199 can be a speaker fixedly disposed in the environment where the first electronic device 110 locates. In one embodiment, when the first electronic device 110 is showing contents (e.g., virtual reality (VR) contents or augmented reality (AR) contents) to the user, the far-field speaker 199 can be used to output sounds related to the contents.

In some embodiments, the first near-field speaker 114 can include one or more speakers near the ears of the user and used to provide sounds related to the contents shown by the first electronic device 110. In other embodiments, the first near-field speaker 114 can be earphones that can operate in a transparent mode while providing sounds related to the contents shown by the first electronic device 110. When the first near-field speaker 114 is in the transparent mode, the user can hear external sounds when wearing the first electronic device 110. In these cases, when the first near-field speaker 114 operating in the transparent mode outputs sounds, not only the sounds from the first near-field speaker 114 can be heard by the user, other environmental sounds (e.g., the sounds provided by the far-field speaker 199) can be heard by the user as well.

In the embodiments of the disclosure, the host 100 can be used to control the volumes of the far-field speaker 199 and the first near-field speaker 114, such that the user of the first electronic device 110 can have a better hearing experience while interacting with the contents provided by the first electronic device 110.

Figure 1B:
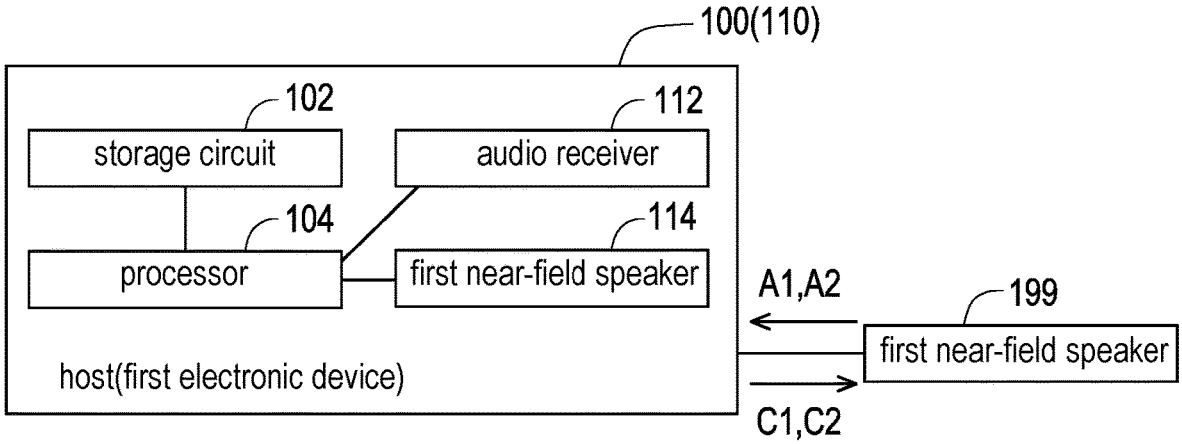
FIG. 1B shows a functional block diagram illustrating a host and a far-field speaker according to FIG. 1A.

See FIG. 1B, which shows a functional block diagram illustrating a host and a far-field speaker according to FIG. 1A. The difference between FIG. 1A and FIG. 1B is that the host 100 and the first electronic device 110 in FIG. 1B can be the same device. For example, the host 100 (i.e., the first electronic device 110) can be a standalone HMD that generates and shows contents to the user, but the disclosure is not limited thereto. Therefore, the introductions of the elements in the host 100 can be referred to the descriptions of FIG. 1A, which would not be repeated herein.

Similar to FIG. 1A, the host 100 (i.e., the first electronic device 110) in FIG. 1B can be used to control the volumes of the far-field speaker 199 and the first near-field speaker 114, such that the user of the first electronic device 110 can have a better hearing experience while interacting with the contents provided by the first electronic device 110.

In the embodiments of the disclosure, the processor 104 may access the modules and/or the program codes stored in the storage circuit 102 to implement the method for adjusting audio of speakers provided in the disclosure, which would be further discussed in the following.

Figure 2:
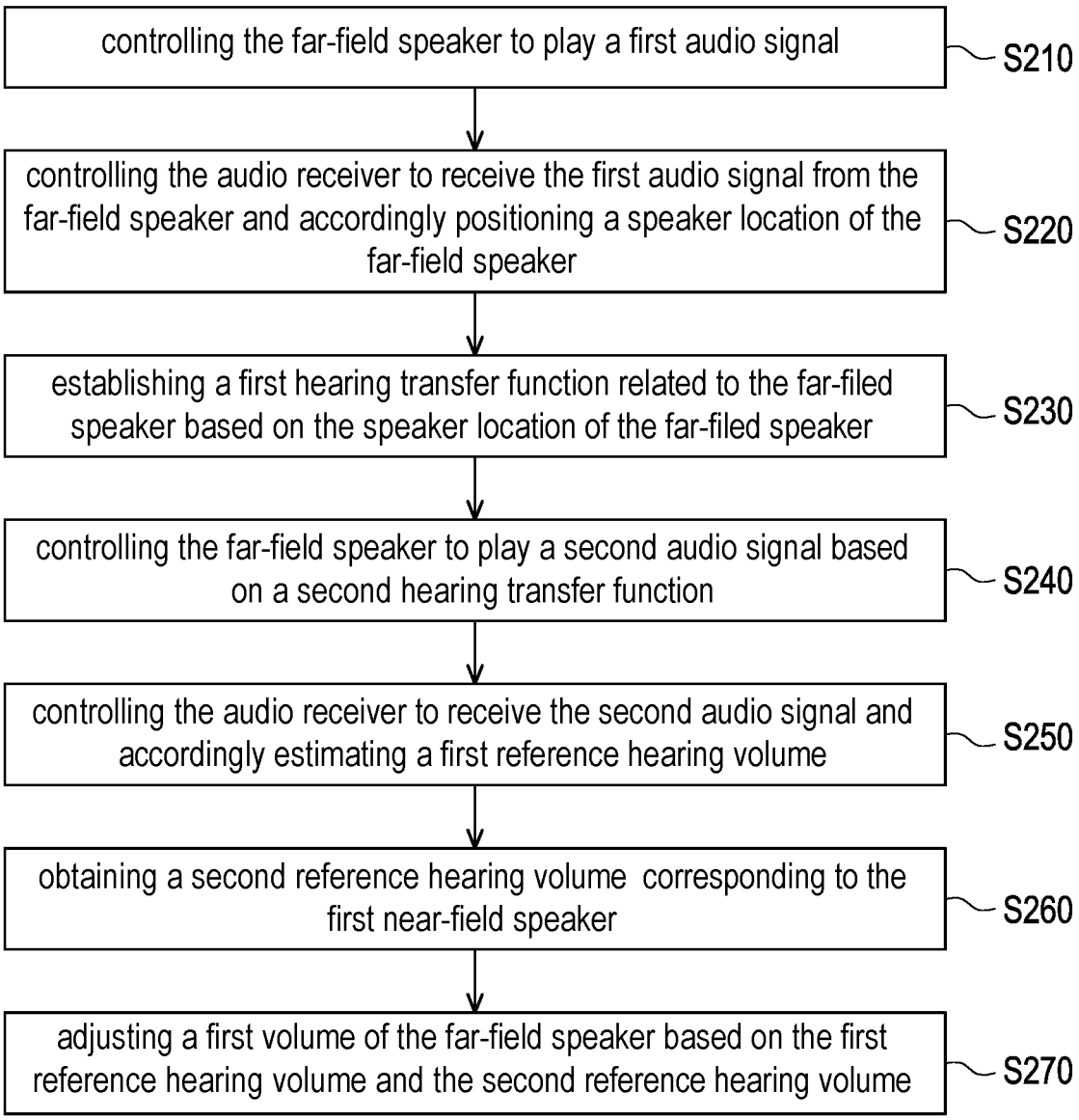
FIG. 2 shows a flow chart of the method for adjusting audio of speakers according to a first embodiment of the disclosure.

See FIG. 2, which shows a flow chart of the method for adjusting audio of speakers according to a first embodiment of the disclosure. The method of this embodiment may be executed by host 100 in FIG. 1A and FIG. 1B, and the details of each step in FIG. 2 will be described below with the components shown in FIG. 1.

Firstly, in step S210, the processor 104 controls the far-field speaker 199 to play a first audio signal A1. In the embodiments of FIG. 1A and FIG. 1B, the connections between the host 100, the first electronic device 110 and the far-field speaker 199 can be wired connection and/or wireless connection using any existing communication protocol. In this case, the processor 104 can send a first control signal C1 to the far-field speaker 199 for controlling the far-field speaker 199 to output the first audio signal A1. Additionally or alternatively, the processor 104 can directly send the first audio signal A1 to the far-field speaker 199 for controlling the far-field speaker 199 to output the first audio signal A1.

In one embodiment, the first audio signal A1 can be an audible/inaudible sound outputted by the far-field speaker 199 and used for volume calibration, but the disclosure is not limited thereto.

In step S220, the processor 104 controls the audio receiver 112 to receive the first audio signal A1 from the far-field speaker 199 and accordingly positioning a speaker location of the far-field speaker 199. In various embodiments, the processor 104 can position the speaker location of the far-field speaker 199 based on any existing positioning mechanisms, such as interaural time difference (ITD) and/or interaural level difference (ILD), but the disclosure is not limited thereto. In one embodiment, the speaker location of the far-field speaker 199 can be understood as a relative location of the far-field speaker 199 to the first electronic device 110.

In step S230, the processor 104 establishes a first hearing transfer function related to the far-filed speaker 199 based on the speaker location of the far-field speaker 199. In one embodiment, the first hearing transfer function can be a first HRTF corresponding to the far-field speaker 199, or any other similar transfer functions corresponding to the far-field speaker 199. In one embodiment, the processor 104 can obtain the first HRTF based on the speaker location of the far-field speaker 199 via existing knowledge in the art.

In step S240, the processor 104 controls the far-field speaker 199 to play a second audio signal A2 based on a second hearing transfer function, wherein the second hearing transfer function is inversed to the first hearing transfer function. In the embodiment where the first hearing transfer function is the first HRTF, the corresponding second hearing transfer function can be a second HRTF inversed to the first HRTF, but the disclosure is not limited thereto.

In one embodiment, the processor 104 can send a second control signal C2 to the far-field speaker 199 for controlling the far-field speaker 199 to output the second audio signal A2. Additionally or alternatively, the processor 104 can directly send the second audio signal A2 to the far-field speaker 199 for controlling the far-field speaker 199 to output the second audio signal A2.

In one embodiment, the second audio signal A2 can be an audible/inaudible sound outputted by the far-field speaker 199 and used for volume calibration, but the disclosure is not limited thereto.

In one embodiment, since the second audio signal A2 is provided based on the second hearing transfer function inversed to the first hearing transfer function, the directional component originally exists in the second audio signal A2 would be suppressed, such that the second audio signal A2 would not sound directional. That is, if the user can hear the second audio signal A2, the user will feel the second audio signal A2 has no directionality.

In step S250, the processor 104 controls the audio receiver 112 to receive the second audio signal A2 and accordingly estimating a first reference hearing volume. In one embodiment, the processor 104 can estimate a received volume of the second audio signal A2 and accordingly estimating a head-center volume as the first reference hearing volume.

Figure 3:
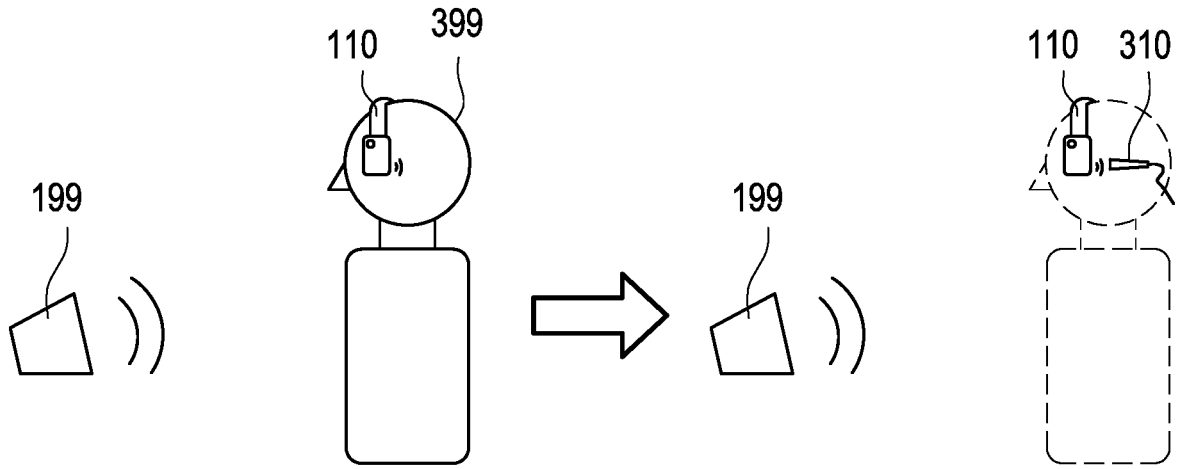
FIG. 3 shows a schematic diagram illustrating the mechanism of estimating the head-center volume according to an embodiment of the disclosure.

See FIG. 3, which shows a schematic diagram illustrating the mechanism of estimating the head-center volume according to an embodiment of the disclosure. In FIG. 3, when the far-field speaker 199 outputs sounds, the first electronic device 110 worn by a dummy head 399 may be used to receive the sounds outputted by the far-field speaker 199, and the frequency response corresponding to the audio receiver 112 on the first electronic device 110 can be obtained.

Next, the dummy head 399 can be removed, and another audio receiver 310 can be placed on a location corresponding to the center of the dummy head 399 for receiving the sounds outputted by the far-field speaker 199. In this case, the frequency response corresponding to the audio receiver 310 can be obtained, and the frequency response difference between the audio receiver 112 and 310 can be accordingly obtained.

Therefore, when the audio receiver 112 receives the second audio signal A2, the processor 104 can estimate the received volume of the second audio signal A2 and accordingly estimate the corresponding head-center volume based on the above frequency response difference, but the disclosure is not limited thereto.

In step S260, the processor 104 obtains a second reference hearing volume corresponding to the first near-field speaker 114. In one embodiment, the volume provided by the first near-field speaker 114 may be adjusted by particular volume adjusting buttons disposed on the first electronic device 110 or some volume adjusting interface in the contents shown by the first electronic device 110 for the user to adjust the volume level of the first near-field speaker 114. Once the volume level is determined, the volume perceived by the user (which is referred to as the second reference hearing volume) can be regarded as known, but the disclosure is not limited thereto.

In step S270, the processor 104 adjusts a first volume of the far-field speaker 199 based on the first reference hearing volume and the second reference hearing volume. In one embodiment, the processor 104 obtains a first volume difference between the first reference hearing volume and the second reference hearing volume. In one embodiment, the processor 104 can obtain the first volume difference by subtracting the first reference hearing volume from the second reference hearing volume, but the disclosure is not limited thereto. Next, the processor 104 can adjust the first volume of the far-field speaker 199 in response to a determination result of whether the first volume difference is between a first threshold (e.g., 0 dB) and a second threshold (e.g., 3 dB), wherein the second threshold is higher than the first threshold.

In one embodiment, the adjusted first volume can be used to estimate a first specific hearing volume corresponding to the far-field speaker 199, and a second volume difference between the first specific hearing volume and the second reference hearing volume is designed to be between the first threshold and the second threshold. That is, the objective of adjusting the first volume is to make the second volume difference between the first threshold and the second threshold.

In one embodiment, in response to determining that the first volume difference is between the first threshold (e.g., 0 dB) and the second threshold (e.g., 3 dB), it represents that the objective has been fulfilled. In this case, the processor 104 can maintain the first volume of the far-field speaker 199.

On the other hand, in response to determining that the first volume difference is lower than the first threshold (e.g., 0 dB), it represents that the objective has not been fulfilled because the current first volume of the far-field speaker 199 is too high. In this case, the processor 104 can reduce the first volume of the far-field speaker 199 subject to fulfil the objective.

In one embodiment, in response to determining that the first volume difference is higher than the second threshold (e.g., 3 dB), it represents that the objective has not been fulfilled because the current first volume of the far-field speaker 199 is too low. In this case, the processor 104 can increase the first volume of the far-field speaker 199 subject to fulfil the objective.

After adjusting the first volume of the far-field speaker 199, the far-field speaker 199 can be used to output the audio contents corresponding to the contents shown by the first electronic device 110 with the adjusted first volume, wherein the audio contents can be pre-processed based on the second hearing transfer function.

Accordingly, the volume (contributed by the first near-field speaker 114 and the far-field speaker 199) perceived by the user of the first electronic device 110 can be more balanced, which can improve the hearing experience of the user. In addition, since the sound provided by the far-field speaker 199 has been processed based on the second hearing transfer function, the user will feel no directionality when hearing the sound provided by the far-field speaker 199. Therefore, no matter how the user wearing the first electronic device 110 moves, the hearing experience would not be affected.

More specifically, if the fixedly disposed far-field speaker 199 is used to provide sounds with directional component, the user may feel weird when moving around because the sound direction may not match the contents seen by the user. However, since the far-field speaker 199 is controlled to provide sound with no directionality, the user will not have the above weird feeling when moving around.

In some embodiments, at least one of the first audio signal A1 and the second audio signal A2 previously played by the far-field speaker 199 can be some signals particularly used for performing the above audio adjustment (e.g., volume adjustment). In other embodiments, at least one of the first audio signal A1 and the second audio signal A2 can also be a part of the audio contents (e.g., music and/or sound effects) corresponding to the contents shown by the first electronic device 110. In this case, the first electronic device 110 can achieve the above audio adjustment in real-time during showing the contents.

In various embodiments, the first electronic device 110 and the far-field speaker 199 can be realized in many implementations. See FIG. 4A to FIG. 4E, which show multiple implementations of the first electronic device and the far-field speaker according to embodiments of the disclosure.

Figure 4A:
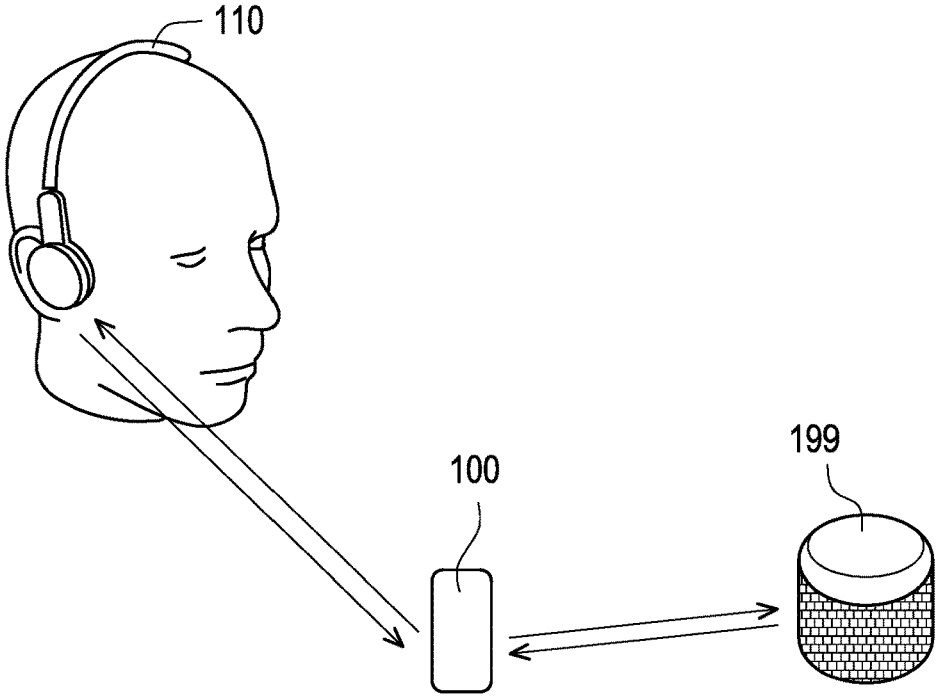
FIG. 4A to FIG. 4E show multiple implementations of the first electronic device and the far-field speaker according to embodiments of the disclosure.

In FIG. 4A, the host 100 can be implemented as a smart device (e.g., a smart phone or tablet) for wirelessly controlling the first electronic device 110 and the far-field speaker 199. In the embodiment, the first electronic device 110 can be implemented as a headset with transparent mode.

Figure 4B:
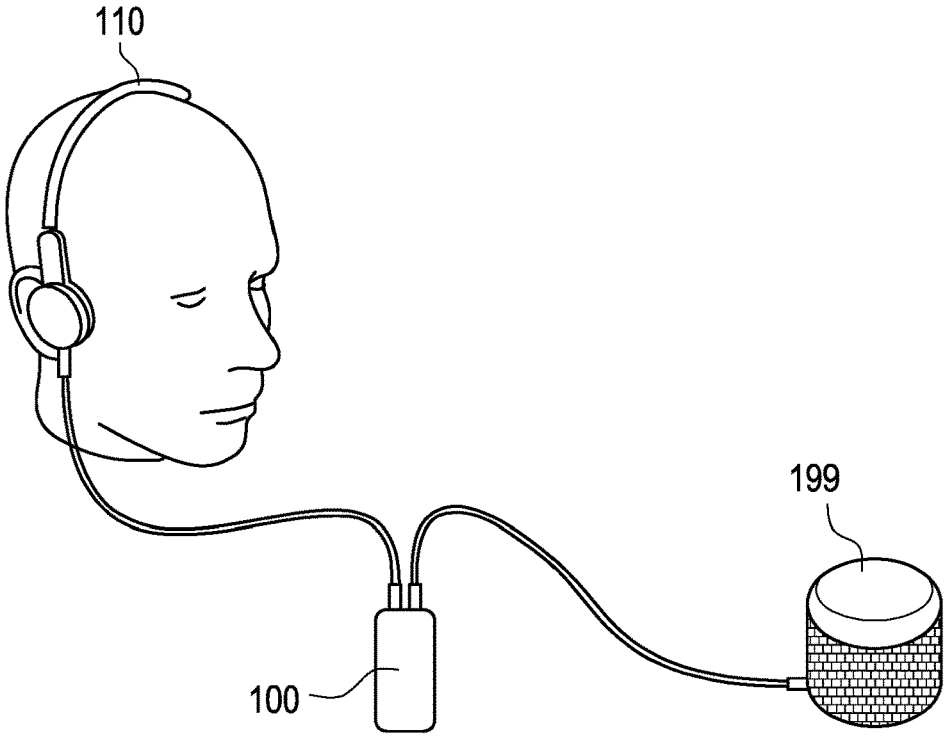

In FIG. 4B, the scenario is similar to FIG. 4A, except that the host 100 is in wired connection with the first electronic device 110 and the far-field speaker 199.

Figure 4C:
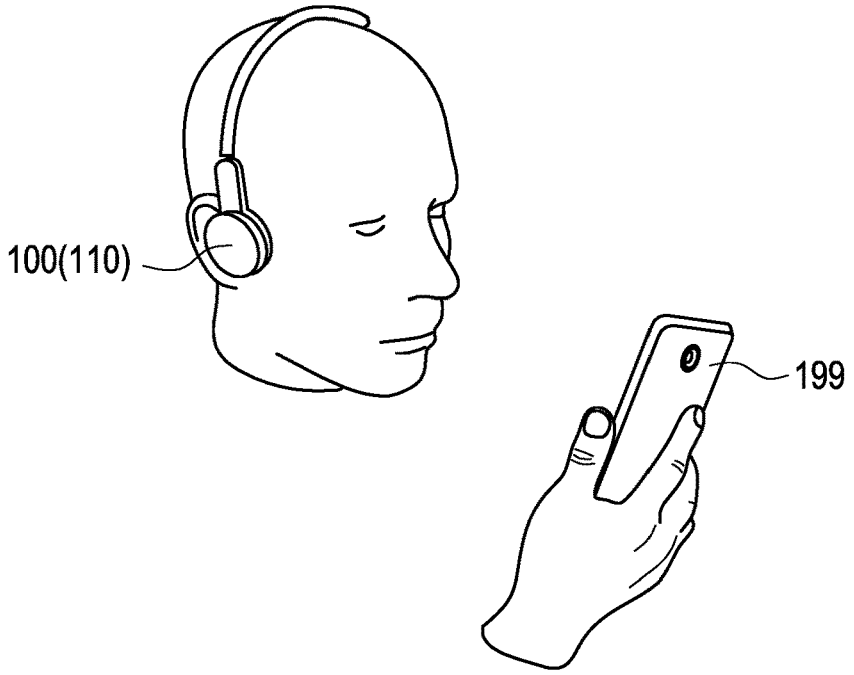

In FIG. 4C, the host 100 and the first electronic device 110 can be integrated as the same device, and the far-field speaker 199 can be implemented as a smart device (e.g., a smart phone or tablet). In this case, the host 100 can balance the volume provided by the first near-field speaker 114 and the far-field speaker 199 as taught in the above.

Figure 4D:
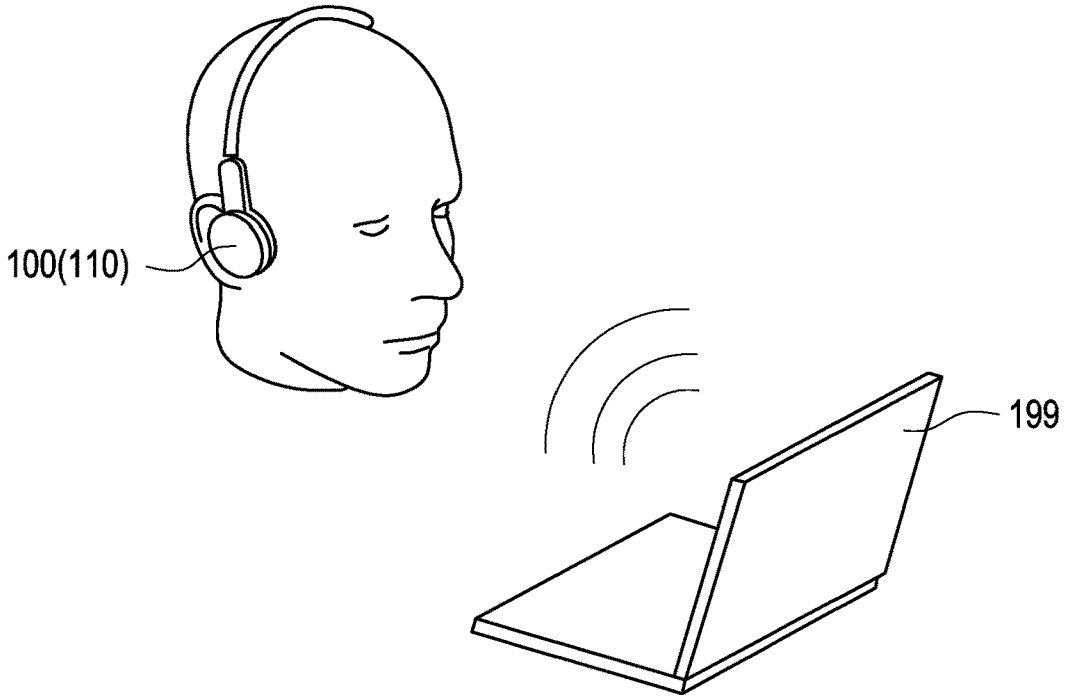

In FIG. 4D, the host 100 and the first electronic device 110 can be integrated as the same device, and the far-field speaker 199 can be implemented as a laptop computer. In this case, the host 100 can balance the volume provided by the first near-field speaker 114 and the far-field speaker 199 as taught in the above.

Figure 4E:
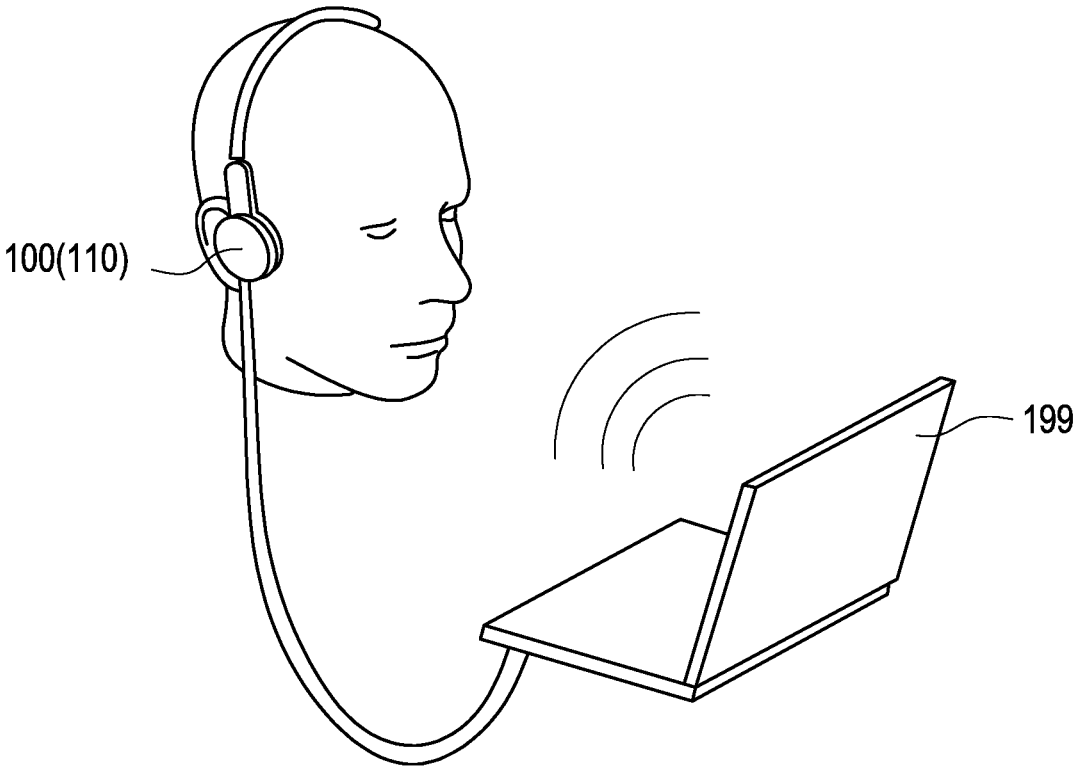

In FIG. 4E, the scenario is similar to FIG. 4D, except that the host 100 is in wired connection with the far-field speaker 199.

Noted that although the firs electronic device 110 is shown as a headset, in other embodiments, the first electronic device 110 can be implemented as the HMD for providing contents to the user, but the disclosure is not limited thereto.

In other embodiments, the method of the disclosure can be further extended to be used in a multiple user scenario, and the details would be provided in the following.

Figure 5:
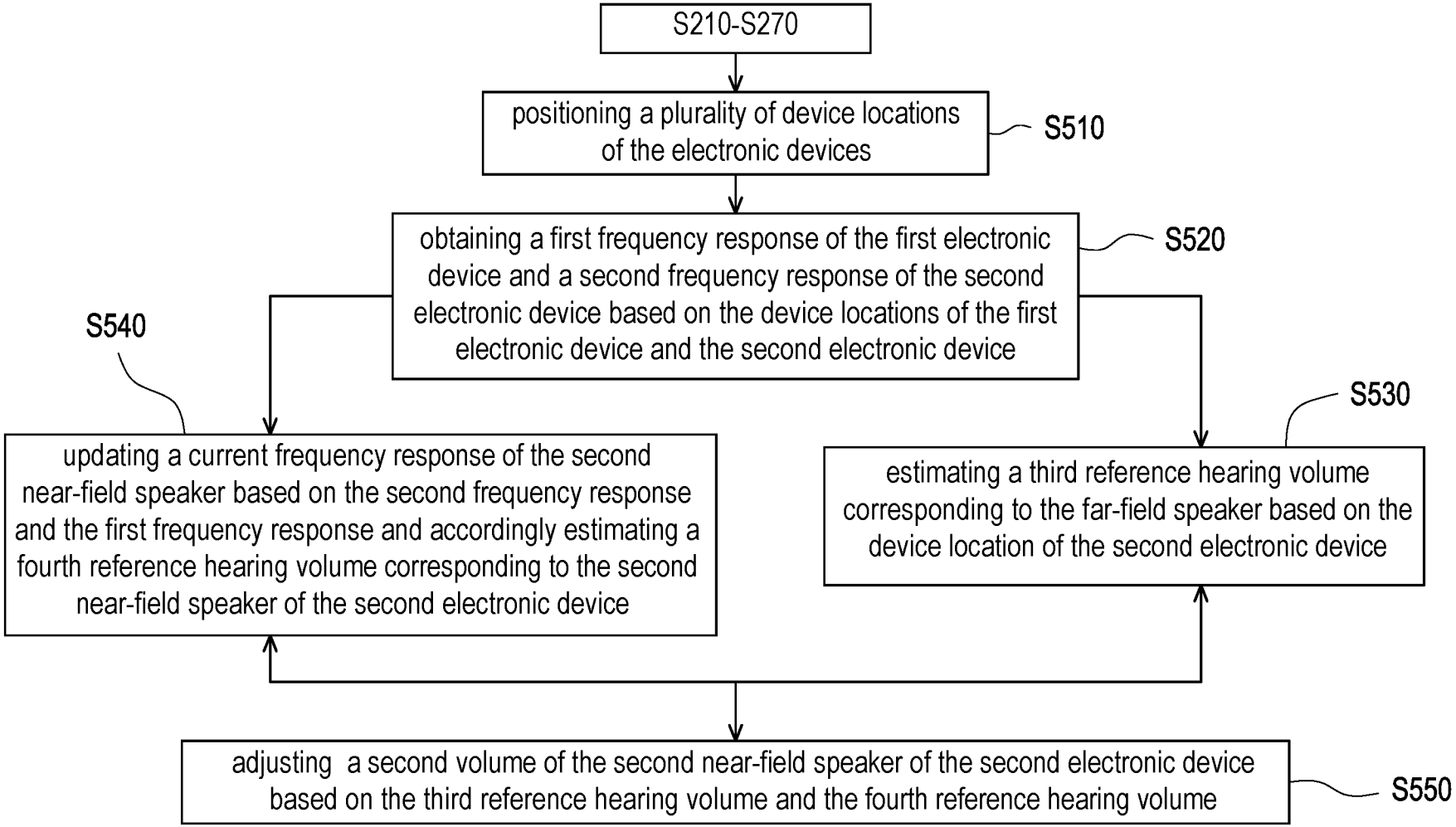
FIG. 5 shows a flow chart of the method for adjusting audio of speakers according to a second embodiment of the disclosure.

See FIG. 5, which shows a flow chart of the method for adjusting audio of speakers according to a second embodiment of the disclosure. The method of this embodiment may be executed by host 100 in FIG. 1A and FIG. 1B, and the details of each step in FIG. 5 will be described below with the components shown in FIG. 1. For better understanding, FIG. 6 would be used as an example for explanation, wherein FIG. 6 shows an application scenario according to an embodiment of the disclosure.

Figure 6:
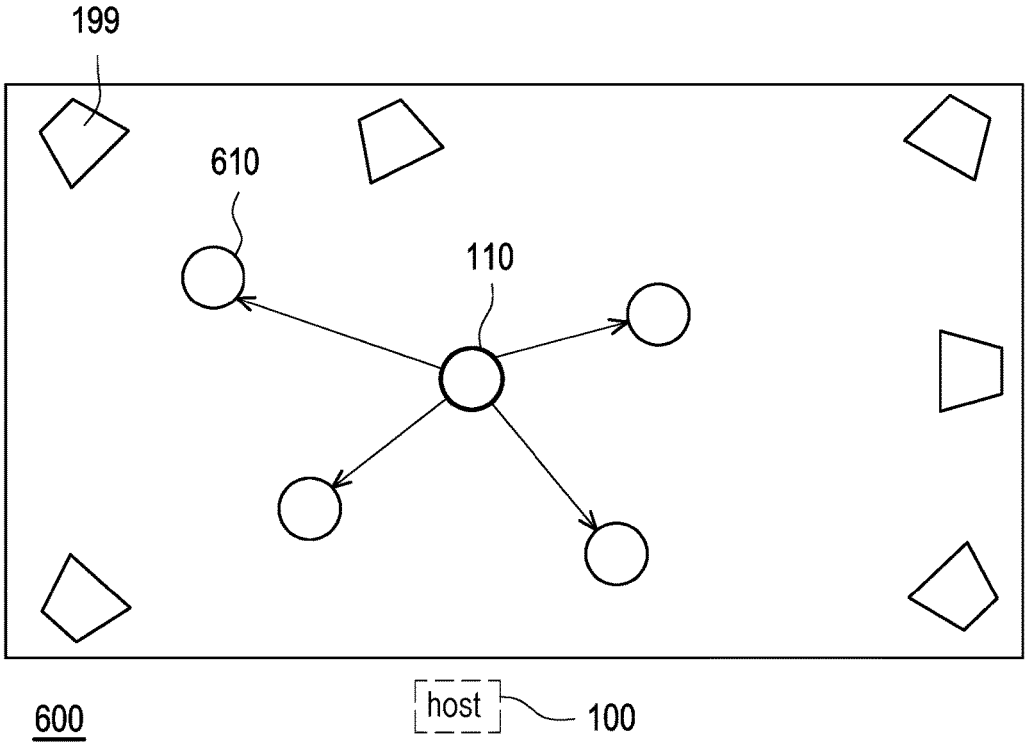
FIG. 6 shows an application scenario according to an embodiment of the disclosure.

In FIG. 6, there are a plurality of electronic devices (shown as circles) and a plurality of far-field speakers (shown as trapezoids) distributed in a field 600, wherein each electronic devices may be an HMD worn by the corresponding user to show VR contents. In the embodiment, the users of the electronic devices are assumed to be immersing in the same VR environment. In this case, the far-field speakers can be used to play the sounds in the VR environment for the users to hear.

In FIG. 6, the first electronic device 110 is one of the electronic devices, and the far-field speaker 199 is one of the far-field speakers. In the embodiment, the host 100 can manage the volumes provided by the electronic devices and the far-field speakers in the field 600. In one embodiment, the host 100 can firstly perform the steps S210-S270 in FIG. 2 to adjust the first volume of the far-field speaker 199. Similarly, the host 100 can also adjust the volumes of other far-field speakers based on the same method.

Once the volume of each far-field speaker is determined based on the first electronic device 110, the host 100 can further adjust the volumes of the near-field speakers of other electronic devices via steps S510-S550 in FIG. 5. For better understanding, a second electronic device 610 (which has a second near-field speaker) in the electronic devices would be used as an example, and people having ordinary skills in the art should be able to know the corresponding ways for adjusting the volumes of the near-field speaker of the rest of the electronic devices, but the disclosure is not limited thereto.

In step S510, the processor 104 positions a plurality of device locations of the electronic devices. In various embodiments, the processor 104 can obtain the device location of each electronic device based on the way of positioning the first electronic device 110 as taught in the first embodiment, which would not be repeated herein.

In step S520, the processor 104 obtains a first frequency response of the first electronic device 110 and a second frequency response of the second electronic device 610 based on the device locations of the first electronic device 110 and the second electronic device 610. In one embodiment, the frequency response corresponding to each location in the field 600 can be measured and recorded in advance. In this case, once the device location of a certain electronic device is known, the corresponding frequency response can be regarded as known.

Therefore, the processor 104 can look for the frequency response corresponding to the device location of the first electronic device 110 and regard this frequency response as the first frequency response of the first electronic device 110, but the disclosure is not limited thereto. Similarly, the processor 104 can obtain the second frequency response of the second electronic device 610 based on the same mechanism.

In step S530, the processor 104 estimates a third reference hearing volume corresponding to the far-field speaker 199 based on the device location of the second electronic device 610. In one embodiment, since the first volume of the far-field 199 speaker and the device location of the second electronic device 610 are known, the processor 104 can accordingly estimate the hearing volume of the user of the second electronic device 610 as the third reference hearing volume, but the disclosure is not limited thereto.

In step S540, the processor 104 updates a current frequency response of the second near-field speaker based on the second frequency response and the first frequency response and accordingly estimate a fourth reference hearing volume corresponding to the second near-field speaker of the second electronic device 610.

Figure 7:
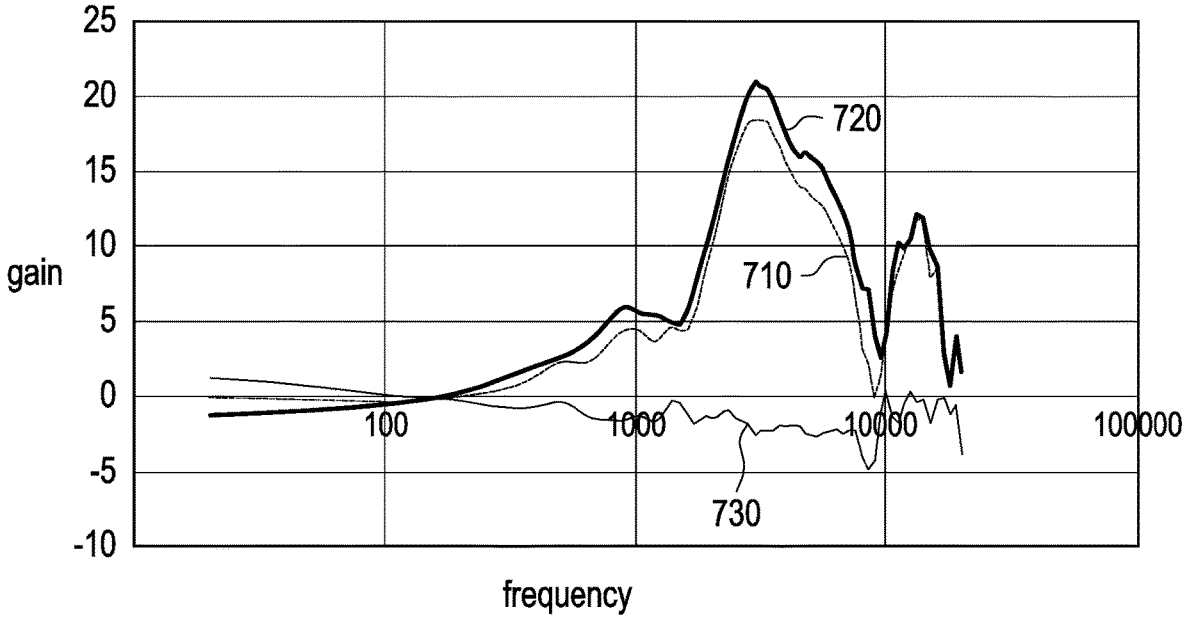
FIG. 7 shows a schematic diagram illustrating the mechanism of updating the second frequency response according to an embodiment of the disclosure.

See FIG. 7, which shows a schematic diagram illustrating the mechanism of updating the second frequency response according to an embodiment of the disclosure. In FIG. 7, the first frequency response 710 of the first electronic device 110 and the second frequency response 720 of the second electronic device 610 are exemplarily illustrated. In the embodiment, the processor 104 can obtain a frequency response difference 730 between the first frequency response 710 and the second frequency response 720 and update the current frequency response of the second near-field speaker by combining the current frequency response of the second near-field speaker with the frequency response difference 730.

In FIG. 7, the processor 104 may subtract the second frequency response 720 from the first second response 710 to obtain the frequency response difference 730. Next, the processor 720 may add the frequency response difference 730 to the current frequency response of the second near-field speaker to update the current frequency response of the second near-field speaker, but the disclosure is not limited thereto.

With the updated current frequency response of the second near-field speaker, the processor 104 can accordingly estimate the hearing volume provided by (the second near-field speaker) of the second electronic device 610 as the fourth reference hearing volume corresponding to the second near-field speaker of the second electronic device 610. In one embodiment, the processor 104 can estimate the fourth reference hearing volume based on similar ways as taught in step S260, which would not be repeated herein.

In step S550, the processor 104 adjusts a second volume of the second near-field speaker of the second electronic device 610 based on the third reference hearing volume and the fourth reference hearing volume. In one embodiment, the processor 104 obtains a third volume difference between the third reference hearing volume and the fourth reference hearing volume. For example, the processor 104 can obtain the third volume difference by subtracting the third reference hearing volume from the fourth reference hearing volume, but the disclosure is not limited thereto. Next, the processor 104 can adjust the second volume of the second near-field speaker in response to a determination result of whether the third volume difference is between the first threshold (e.g., 0 dB) and the second threshold (e.g., 3 dB).

In one embodiment, the adjusted second volume can be used to estimate a second specific hearing volume corresponding to the second near-field speaker, and a fourth volume difference between the third specific hearing volume and the fourth reference hearing volume is designed to be between the first threshold and the second threshold. That is, the objective about adjusting the second volume is to make the fourth volume difference between the first threshold and the second threshold.

In one embodiment, in response to determining that the third volume difference is between the first threshold (e.g., 0 dB) and the second threshold (e.g., 3 dB), it represents that the objective has been fulfilled. In this case, the processor 104 can maintain the second volume of the second near-field speaker of the second electronic device 610.

On the other hand, in response to determining that the third volume difference is lower than the first threshold (e.g., 0 dB), it represents that the objective has not been fulfilled because the current second volume of the second near-field speaker of the second electronic device is too low. In this case, the processor 104 can increase the second volume of the second near-field speaker of the second electronic device to fulfil the objective.

In one embodiment, in response to determining that the third volume difference is higher than the second threshold (e.g., 3 dB), it represents that the objective has not been fulfilled because the current second volume of the far-field speaker 199 is too high. In this case, the processor 104 can reduce the second volume of the second near-field speaker of the second electronic device subject to fulfil the objective.

After adjusting the second volume of the second near-field speaker of the second electronic device, the second near-field speaker can be used to output the audio contents corresponding to the contents shown by the second electronic device 610 with the adjusted second volume.

Accordingly, the volume (contributed by the second near-field speaker of the second electronic device 610 and the far-field speaker 199) perceived by the user of the second electronic device 610 can be more balanced, which can improve the hearing experience of the user. In addition, since the sound provided by the far-field speaker 199 has been processed based on the second hearing transfer function, the user will feel no directionality when hearing the sound provided by the far-field speaker 199. Therefore, no matter how the user wearing the second electronic device 610 moves, the hearing experience would not be affected.

In some embodiments, after fulfilling the above objective, the volume perceived by the user of the second electronic device 610 may be too loud to harm the ears of the user. In this case, the processor 104 can further determine that whether a sum of the third reference hearing volume and the second specific hearing volume is higher than a volume threshold, wherein the volume threshold may be designed to be a volume level that would harm the hearing of people.

In one embodiment, in response to determining that the sum of the third reference hearing volume and the second specific hearing volume is higher than the volume threshold, it represents that the volume perceived by the user of the second electronic device 610 may harm the hearing of the user. Therefore, the processor 104 can reduce the first volume of the far-field speaker 199 and accordingly adjust the second volume of the second near-field speaker subject to fulfil the above objective.

On the other hand, in response to determining that the sum of the third reference hearing volume and the second specific hearing volume is not higher than the volume threshold, it represents that the volume perceived by the user of the second electronic device 610 may be harmless to the hearing of the user. Therefore, the processor 104 can maintain the volumes of the second near-field speaker and the far-field speaker 199, but the disclosure is not limited thereto.

Based on the above, the processor 104 can adjust the volumes of the near-field speakers of other electronic devices to balance the perceived by the users of these electronic devices.

In some embodiments, the processor 104 may not successfully apply the above volume adjusting mechanism to every electronic device. That is, for some electronic devices, the volume perceived by the corresponding user may not be properly balanced. In this case, the processor 104 may decide to choose another electronic device and perform steps in FIG. 2 while regarding the newly chosen electronic device as a new first electronic device. Therefore, the first volume of the far-field speaker 199 would be determined based on the newly chosen electronic device.

For example, in response to determining that the second volume cannot be adjusted to make the fourth volume difference between the first threshold and the second threshold, it represents that the volume perceived by the user of the second electronic device 610 may not be properly balanced. In this case, the processor 104 can choose the second electronic device 610 as the new first electronic device and adjust the first volume of the far-field speaker 199 based on the second electronic device 610 by performing the steps in FIG. 2, which would not be repeated herein.

The disclosure further provides a computer readable medium for executing the method for adjusting audio of speakers. The computer readable medium is composed of a plurality of program instructions (for example, a setting program instruction and a deployment program instruction) embodied therein. These program instructions can be loaded into the host 100 and executed by the same to execute the method for adjusting audio of speakers and the functions of the host 100 described above.

To sum up, in the scenario where a user can hear the sounds from a near-field speaker and a far-field speaker, the embodiments of the disclosure can suppress the directionality of the sounds from the far-field speaker and balancing the volumes of the near-field speaker and the far-field speaker. Accordingly, the hearing experience of the user can be improved.

In addition, the embodiments of the disclosure can be further applied to the scenario where multiple users are experiencing the same virtual environment in the same field. Accordingly, the users can perceive balancing volumes contributed by the far-field speakers in the field and the corresponding near-field speaker.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for adjusting audio of speakers, adapted to a host, comprising:

controlling a far-field speaker to play a first audio signal;

controlling an audio receiver to receive the first audio signal from the far-field speaker and accordingly positioning a speaker location of the far-field speaker;

establishing a first hearing transfer function related to the far-field speaker based on the speaker location of the far-field speaker;

controlling the far-field speaker to play a second audio signal based on a second hearing transfer function, wherein the second hearing transfer function is inversed to the first hearing transfer function;

controlling the audio receiver to receive the second audio signal and accordingly estimating a first reference hearing volume;

obtaining a second reference hearing volume corresponding to a first near-field speaker; and adjusting a first volume of the far-field speaker based on the first reference hearing volume and the second reference hearing volume.

2. The method according to claim 1, wherein the first hearing transfer function is a first head-related transfer function, and the second hearing transfer function is a second head-related transfer function inversed to the first head-related transfer function.

3. The method according to claim 1, wherein the step of estimating the first reference hearing volume comprises:

estimating a received volume of the second audio signal and accordingly estimating a head-center volume as the first reference hearing volume.

4. The method according to claim 1, wherein the step of adjusting the first volume of the far-field speaker based on the first reference hearing volume and the second reference hearing volume comprises:

obtaining a first volume difference between the first reference hearing volume and the second reference hearing volume;

adjusting the first volume of the far-field speaker in response to a determination result of whether the first volume difference is between a first threshold and a second threshold, wherein the second threshold is higher than the first threshold.

5. The method according to claim 4, wherein the step of adjusting the first volume of the far-field speaker in response to the determination result of whether the first volume difference is between the first threshold and the second threshold comprises:

in response to determining that the first volume difference is lower than the first threshold, reducing the first volume of the far-field speaker;

in response to determining that the first volume difference is higher than the second threshold, increasing the first volume of the far-field speaker;

in response to determining that the first volume difference is between the first threshold and the second threshold, maintaining the first volume of the far-field speaker.

6. The method according to claim 4, wherein the adjusted first volume is used to estimate a first specific hearing volume corresponding to the far-field speaker, and a second volume difference between the first specific hearing volume and the second reference hearing volume is between the first threshold and the second threshold.

7. The method according to claim 1, further comprising:

positioning a plurality of device locations of a plurality of electronic devices, wherein the electronic devices comprise a first electronic device and a second electronic device, the first electronic device of the electronic devices is disposed with the audio receiver and the first near-field speaker, and the second electronic device is disposed with a second near-field speaker;

obtaining a first frequency response of the first electronic device and a second frequency response of the second electronic device based on the device locations of the first electronic device and the second electronic device;

estimating a third reference hearing volume corresponding to the far-field speaker based on the device location of the second electronic device;

updating a current frequency response of the second near-field speaker based on the second frequency response and the first frequency response and accordingly estimating a fourth reference hearing volume corresponding to the second near-field speaker of the second electronic device;

adjusting a second volume of the second near-field speaker of the second electronic device based on the third reference hearing volume and the fourth reference hearing volume.

8. The method according to claim 7, wherein the step of updating the second frequency response based on the first frequency response comprises:

obtaining a frequency response difference between the first frequency response and the second frequency response; and updating the current frequency response of the second near-field speaker by combining the current frequency response of the second near-field speaker with the frequency response difference.

9. The method according to claim 7, wherein the step of adjusting the second volume of the second near-field speaker of the second electronic device based on the third reference hearing volume and the fourth reference hearing volume comprises:

obtaining a third volume difference between the third reference hearing volume and the fourth reference hearing volume;

adjusting the second volume of the second near-field speaker in response to a determination result of whether the third volume difference is between a first threshold and a second threshold, wherein the second threshold is higher than the first threshold.

10. The method according to claim 9, wherein the step of adjusting the second volume of the second near-field speaker in response to the determination result of whether the third volume difference is between the first threshold and the second threshold comprises:

in response to determining that the third volume difference is lower than the first threshold, increasing the second volume of the second near-field speaker;

in response to determining that the volume difference is higher than the second threshold, reducing the second volume of the second near-field speaker;

in response to determining that the third volume difference is between the first threshold and the second threshold, maintaining the second volume of the second near-field speaker.

11. The method according to claim 9, wherein the adjusted second volume is used to estimate a second specific hearing volume corresponding to the second near-field speaker, and a fourth volume difference between the third reference hearing volume and the second specific hearing volume is between the first threshold and the second threshold.

12. The method according to claim 11, further comprising:

in response to determining that a sum of the third reference hearing volume and the second specific hearing volume is higher than a volume threshold, reducing the first volume of the far-field speaker.

13. The method according to claim 11, further comprising:

in response to determining that the second volume cannot be adjusted to make the fourth volume difference between the first threshold and the second threshold, adjusting the first volume of the far-field speaker based on the second electronic device.

14. A host for adjusting audio of speakers, comprising:

a non-transitory storage circuit, storing a program code; and a processor, coupled to the storage circuit and accessing the program code to perform:

controlling a far-field speaker to play a first audio signal;

controlling an audio receiver to receive the first audio signal from the far-field speaker and accordingly positioning a speaker location of the far-field speaker;

establishing a first hearing transfer function related to the far-field speaker based on the speaker location of the far-field speaker;

controlling the far-field speaker to play a second audio signal based on a second hearing transfer function, wherein the second hearing transfer function is inversed to the first hearing transfer function;

controlling the audio receiver to receive the second audio signal and accordingly estimating a first reference hearing volume;

obtaining a second reference hearing volume corresponding to a first near-field speaker; and adjusting a first volume of the far-field speaker based on the first reference hearing volume and the second reference hearing volume.

15. The host according to claim 14, wherein the processor performs:

obtaining a first volume difference between the first reference hearing volume and the second reference hearing volume;

adjusting the first volume of the far-field speaker in response to a determination result of whether the first volume difference is between a first threshold and a second threshold, wherein the second threshold is higher than the first threshold.

16. The host according to claim 14, wherein the audio receiver and the first near-field speaker is disposed in a first electronic device, and the host is the first electronic device or used to control the first electronic device.

17. The host according to claim 16, wherein the processor further performs:

positioning a plurality of device locations of a plurality of electronic devices, wherein the electronic devices comprise the first electronic device and a second electronic device, and the second electronic device is disposed with a second near-field speaker;

obtaining a first frequency response of the first electronic device and a second frequency response of the second electronic device based on the device locations of the first electronic device and the second electronic device;

estimating a third reference hearing volume corresponding to the far-field speaker based on the device location of the second electronic device;

updating a current frequency response of the second near-field speaker based on the second frequency response and the first frequency response and accordingly estimating a fourth reference hearing volume corresponding to the second near-field speaker of the second electronic device;

adjusting a second volume of the second near-field speaker of the second electronic device based on the third reference hearing volume and the fourth reference hearing volume.

18. The host according to claim 17, wherein the processor performs:

obtaining a frequency response difference between the first frequency response and the second frequency response; and updating the current frequency response of the second near-field speaker by combining the current frequency response of the second near-field speaker with the frequency response difference.

19. The host according to claim 17, wherein the processor performs:

obtaining a third volume difference between the third reference hearing volume and the fourth reference hearing volume;

adjusting the second volume of the second near-field speaker in response to a determination result of whether the third volume difference is between a first threshold and a second threshold, wherein the second threshold is higher than the first threshold.

20. A non-transitory computer readable medium, the computer readable medium recording an executable computer program, the executable computer program being loaded by a host to perform steps of:

controlling a far-field speaker to play a first audio signal;

controlling an audio receiver to receive the first audio signal from the far-field speaker and accordingly positioning a speaker location of the far-field speaker;

establishing a first hearing transfer function related to the far-field speaker based on the speaker location of the far-field speaker;

controlling the far-field speaker to play a second audio signal based on a second hearing transfer function, wherein the second hearing transfer function is inversed to the first hearing transfer function;

controlling the audio receiver to receive the second audio signal and accordingly estimating a first reference hearing volume;

obtaining a second reference hearing volume corresponding to a first near-field speaker; and adjusting a first volume of the far-field speaker based on the first reference hearing volume and the second reference hearing volume.

* * * * *